US005836040A

United States Patent [19]

Giacomelli

[11] Patent Number: 5,836,040

[45] Date of Patent: Nov. 17, 1998

[54] TOOL FOR APPLYING VARNISH, GLUE OR ANY OTHER MATERIAL REQUIRING SMOOTHING

[76] Inventor: Ezio Giacomelli, Via Omero, 19, Civitanova Marche, Italy

[21] Appl. No.: 725,994

[22] Filed: Oct. 4, 1996

[51] Int. Cl.[6] ..... B25G 1/06

[52] U.S. Cl. ..... 15/235.8; 15/172; 15/144.2

[58] Field of Search ..... 15/172, 143.1, 15/229, 245.1, 235.8, 144.2, 229.1, 229.2, 229.3, 229.4, 229.5, 229.6, 229.7, 229.8, 229.9, 229.11, 229.12, 229.13, 229.14

[56] References Cited

U.S. PATENT DOCUMENTS 4,982,470 1/1991 Sazbo ..... 15/104

FOREIGN PATENT DOCUMENTS 676374 2/1930 France .
896547 11/1953 Germany .
190386 12/1922 United Kingdom .

*Primary Examiner*—Jeanette E. Chapman
*Attorney, Agent, or Firm*—Beveridge, DeGrandi, Weilacher & Young, LLP

[57] ABSTRACT

This invention concerns a building trade tool for smoothing flat surfaces coated with varnish, glue or other fluid materials, consisting of a handle fitted with a spatula at the end, rotating to the left or to the right with respect to the axis of the handle.

13 Claims, 1 Drawing Sheet

TOOL FOR APPLYING VARNISH, GLUE OR ANY OTHER MATERIAL REQUIRING SMOOTHING

Figure 1:
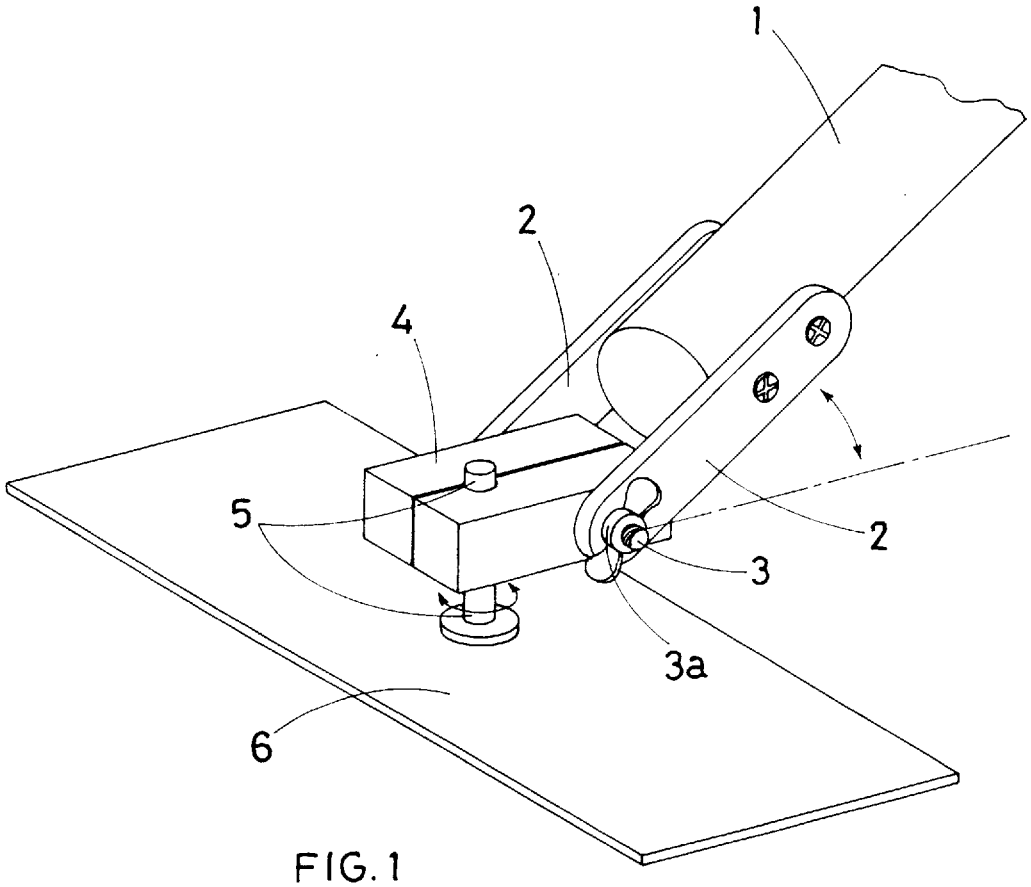

This patent application concerns a tool for smoothing varnish, glues or other materials.

The tool in question has no precedents in the state of the art and is designed to facilitate the work of those who, above all in the building trade, need to apply and smooth parquet varnish, tiling glue or any other fluid or semi-fluid material to flooring. Since no specific tools exist for this job, horizontal surfaces are generally smoothed by hand with the labourer working on his knees or in a crouched position to smooth down the fluid material with a spatula.

In order to perform this job correctly, the worker holds the spatula, which has a handle fitted at the centre of the upper surface, so that the longitudinal axis is perpendicular to the axis of the worker's forearm; the worker then places the spatula on the material and works the spatula alternatively to the left and to the right with rotating movements of his wrist. The spatula thus traces semi-circular patterns on the fluid material, which are considered to be ideal for smoothing fluid material.

The above description of the procedure for smoothing down surfaces reveals that this is very strenuous work which a labourer will perform for many hours during the day.

The work is tiring not only because of the uncomfortable position, crouched or stooped, in which the operator works, but also because of the considerable effort of "rubbing" the spatula for many hours a day against the material with a very short lever, namely the forearm of the worker.

The inventive idea is to design a tool which allows the worker to perform the job of smoothing down a fluid material in the same way—namely with the same semi-circular movement of the spatula against the surface of the fluid material—but which can at the same time reduce the effort required by the worker. Thanks to the tool according to the invention, the labourer can in fact work in a more comfortable standing position with a longer lever that significantly reduces the effort required to "rub" the fluid material.

The tool in question consists essentially of a long handle fitted at the bottom end with a pair of parallel metal brackets having transversally perforated ends; a parallelepiped metal block supporting the spatula is hinged between said two brackets by means of a pin fitted between the perforated ends.

This parallelepiped block rotates freely upwards and downwards between said brackets but can also be fixed securely by means of a wing nut into a suitable position.

This means that it is possible to change the inclination of the block as required with respect to the handle axis in order to regulate the angle of the same with respect to the above spatula, according to the height of the worker in question.

The free end of said block in fact has a through hole whose axis is perpendicular to the longitudinal axis of the block; a pin being housed within said hole which rotates idly thanks to a common bearing.

The spatula is fixed securely at the bottom end of said idle pin, and consequently underneath the above parallelepiped block. It is evident that the spatula according to the invention can rotate to the left and to the right of the metal block that supports the same, utilizing the idle pin as pivoting point.

In order to explain the operating principle of the tool according the invention more clearly, it is sufficient to say that when the labourer holds the handle, he simply moves the tool alternatively and continuously to the left and to the right so that the spatula, thanks also to the resistance exercised against the same by the mass of fluid material, rotates with respect to the longitudinal axis of the parallelepiped block which supports it, thus tracing the semi-circular movements required to smooth down the fluid material correctly.

To more fully clarify the present invention, the description thereof continues with reference to the enclosed drawings which are intended for purposes of illustration and not in a limiting sense where FIG. 1 is an axonometric view of the tool according to the invention.

With reference to this drawing, this tool consists of a handle (1) at whose bottom end two adjacent metal brackets (2) featuring an end transversal hole, are fixed.

The pair of holes on said brackets (2) house a pin (3) which acts as a pivot for a parallelepiped metal block (4) placed in an intermediate position with respect to the brackets (2); the inclination of the block (4) with respect to the brackets (2) and therefore with respect to the handle (1) being adjustable by releasing and then tightening a regulation and fixing wing nut **(3*a*)**.

The front end of said block (4) features a through hole which is perpendicular to the longitudinal axis of the block in which an idle rotating pin (5) is fitted thanks to the fact that a bearing is fitted between the same.

The bottom end of said rotating pin (5) is fixed at the centre of the upper face of a spatula (6) which can therefore rotate towards the left or the right integrally with said pin (5) with respect to the support block (4) and therefore with respect to the axis of the handle (1).

I claim:

1. A tool for smoothing varnish, glue, or other fluid material, comprising:

a handle;

a support block pivotally coupled with said handle, said support block defining a projecting pin hole;

locking means for locking said handle at an angle with respect to said support block; and a spatula having a projecting pin extending therefrom, said projecting pin being rotatably received in said projecting pin through hole such that said spatula pivots about a pivot axis defined by said projecting pin.

2. The tool defined by claim 1, further comprising:

two brackets fixed to said handle, said support block being pivotally coupled to said two brackets.

3. The tool defined by claim 2, further comprising:

a pivot pin;

wherein said support block and said two brackets each define a pivot pin receiving hole, said pivot pin being received in said pivot pin receiving hole defined in each of said support block and said two brackets.

4. The tool defined by claim 3, wherein:

said locking means includes at least one wing nut rotatably engaged with said pivot pin such that when said wing nut is rotatably tightened, said support block is releasably secured between said brackets.

5. The tool defined by claim 4, wherein:

said projecting pin is located essentially in the center of said spatula.

6. A tool for smoothing varnish, glue, or other fluid material, comprising:

a support block;

a handle pivotally coupled with said support block about a first pivot axis; and a spatula pivotally coupled with said support block about a second pivot axis, wherein said first pivot axis and said second pivot axis are non-intersecting, and said second pivot axis is essentially perpendicular to said spatula.

7. The tool defined by claim 6, wherein:

said second pivot axis is further essentially perpendicular to said support block.

8. The tool defined by claim 7, wherein:

said spatula and said support block are disposed in an essentially parallel arrangement for every angular position of said handle about said first pivot axis.

9. The tool defined by claim 8, wherein:

said handle is pivotally coupled to said support block via a connecting assembly including a bracket.

10. The tool defined by claim 6, wherein:

said support block defines a projecting pin hole, and said spatula includes a projecting pin extending therefrom, said projecting pin being rotatably received in said projecting pin hole, an axis defined by said projecting pin coinciding with said second pivot axis.

11. The tool defined by claim 10, further comprising:

locking means for locking said handle at an angle relative to said support block.

12. The tool defined by claim 11, wherein:

said handle is pivotally coupled to said support block via a connecting assembly including at least two brackets and a pivot pin.

13. The tool defined by claim 12, wherein:

said locking means includes at least one wing nut rotatably engaged with said pivot pin such that when said wing nut is rotatably tightened, said support block is locked between said brackets.

* * * * *